US007237533B2

(12) United States Patent
Lehtonen

(10) Patent No.: US 7,237,533 B2
(45) Date of Patent: Jul. 3, 2007

(54) ARRANGEMENT IN FUEL INJECTION APPARATUS

(75) Inventor: Kai Lehtonen, Vaasa (FI)

(73) Assignee: Wartsila Finland OY, Vaasa (FI)

( * ) Notice: Subject to any disclaimer, the term of this patent is extended or adjusted under 35 U.S.C. 154(b) by 42 days.

(21) Appl. No.: 10/541,280

(22) PCT Filed: Jan. 9, 2004

(86) PCT No.: PCT/FI2004/000006

§ 371 (c)(1),
(2), (4) Date: Aug. 19, 2005

(87) PCT Pub. No.: WO2004/063558

PCT Pub. Date: Jul. 29, 2004

(65) Prior Publication Data

US 2006/0096578 A1 May 11, 2006

(30) Foreign Application Priority Data

Jan. 15, 2003 (FI) ..... 20030054

(51) Int. Cl.
*F02M 69/52* (2006.01)
*F02M 69/46* (2006.01)

(52) U.S. Cl. ..... 123/456; 123/198 D

(58) Field of Classification Search ..... 123/456, 123/447, 198 DB, 198 F, 198 D, 446; 137/498
See application file for complete search history.

(56) References Cited

U.S. PATENT DOCUMENTS

| | | | | |
|---|---|---|---|---|
| 3,780,716 | A | 12/1973 | Fenne | |
| 5,692,476 | A | 12/1997 | Egler et al. | |
| 6,357,415 | B1 | 3/2002 | Mori | |
| 6,374,802 | B1 | 4/2002 | Boecking | |
| 6,848,424 | B2 * | 2/2005 | Watanabe | 123/456 |
| 6,953,052 | B2 * | 10/2005 | Lehtonen | 137/517 |
| 7,066,148 | B2 * | 6/2006 | Nishiwaki | 123/456 |
| 2006/0090736 | A1 * | 5/2006 | Nishiwaki et al. | 123/456 |

FOREIGN PATENT DOCUMENTS

| | | |
|---|---|---|
| DE | 332451 | 1/1921 |
| DE | 196 21 021 | 10/1997 |
| DE | 196 40 085 | 4/1998 |
| DE | 197 47 092 | 4/1999 |
| DE | 102 54 465 | 6/2003 |

* cited by examiner

*Primary Examiner*—Mahmoud Gimie
(74) *Attorney, Agent, or Firm*—Smith-Hill and Bedell

(57) ABSTRACT

An arrangement in a fuel injection system for controlling the fuel injection includes a body part having a space, through which the fuel to be injected during operation flows, and a fuel inlet opening and an outlet opening opening into the space. A piston is arranged movably inside the space, the piston having a channel arranged therein for creating a flow connection between the fuel inlet opening and the outlet opening, whereby the piston divides the space into a first part connected with the inlet opening and a second part connected with the outlet opening. A spring creates a force acting on the piston in a direction opposite to that of the main fuel flow. The piston and the body part are formed so that when the piston is in the end adjacent the fuel inlet opening it delimits a third space, the volume of which depends on the mutual positions of the piston and the body part.

16 Claims, 5 Drawing Sheets

A-A

ARRANGEMENT IN FUEL INJECTION APPARATUS

This is a national stage application filed under 35 U.S.C 371 based on International Application No. PCT/FI2004/000006 filed Jan. 9, 2004, and claims priority under 35 U.S.C 119 of Finnish Patent Application No. 20030054 filed Jan. 15, 2003.

BACKGROUND OF THE INVENTION

The present invention relates to an arrangement in a fuel injection apparatus.

Common rail injection systems utilizing pressure accumulators are currently commonly used in connection with piston engines. In such systems the fuel stored in injection pressure in the so-called pressure accumulator is injected into the combustion chamber of the engine by controlling the injector valve.

Generally, a flow fuse is used as a safety means in injection systems. The flow fuse is usually arranged between the pressure accumulator and the injection valve. The flow fuse closes the flow path from the accumulator in case of a leak and in case the injection valve is stuck, for example, in the open position, in which case there's a situation when fuel can uncontrollably leak into the cylinder combustion chamber. To avoid this situation, U.S. Pat. No. 3,780,716 and WO 95/17594 disclose a flow fuse restricting the fuel flow volume. Typically the flow fuse includes a cylinder space that further includes a piston apparatus having a spring load acting against the fuel flow direction during injection. During normal action the fuel volume needed for each injection corresponds with the volume displaced by the piston. If, for some reason, the injection valve starts to leak, the piston will move to its other limit position, where it will close the flow.

In a typical common rail system the injection pressure reaches a high pressure level almost instantaneously when the needle of the injector nozzle opens. As a result of this, the fuel mass flow is great right at the beginning of the injection during injection of fuel into the combustion chamber. In such a case the pressure in the combustion chamber can increase too fast for reaching optimum performance.

An aim of the present invention is to produce an arrangement in the fuel injection apparatus minimizing the problems associated with prior art. It is an especial aim of the invention to produce an arrangement for restricting the fuel mass flow in the beginning of the injection phase.

SUMMARY OF THE INVENTION

According to the invention, an arrangement in the fuel injection system for controlling the fuel injection comprises a body part with a space arranged therein, through which space the fuel to be injected flows during operation, the space further having an inlet and an outlet opening therein. The arrangement further comprises a piston means, arranged movably in the space and having a channel or the like for creating a flow connection between the fuel inlet and the fuel outlet openings. In this arrangement the piston means can divide the space into the first part, being in connection with the inlet opening, and the second part, being in connection with the outlet opening. The arrangement further comprises a spring or the like for creating a force acting on the piston means in a direction opposite to the main direction of fuel flow. The main characterizing feature of the arrangement is that as the piston means is in the end adjacent the inlet opening or near it, the piston means and the body part delimit at least one third part of the space, the volume of which is dependent on the mutual positions of the piston means and the body part.

Preferably the piston means and the space are cylindrically formed and together they form at least two separate sliding surfaces, formed at different distances in relation to the central axis of the piston means and the space. In the arrangement, the third part of the space and its condition can be defined by means of these sliding surfaces in a preferred way. In the arrangement, when the piston means is in the end adjacent the inlet opening, the volume of the third part of the space is at its smallest, and as the piston means retracts to a certain distance from the end adjacent the inlet opening, the volume of the third space increases and as the piston means retracts beyond the said certain distance, the third and the first parts of the space are combined. The third space part is in continuous flow connection with the fuel inlet opening and/or the first space part. The flow connection is achieved by means of a throttling channel or the like.

The space is preferably cylindrical and it comprises at least two portions having a different diameter, of which portions the one having the smaller diameter is located at the end adjacent the inlet opening. The piston means correspondingly includes two portions having different diameters, with the portion having the smaller diameter being located in the end adjacent the inlet opening and both the longitudinal length of the section of the piston means having the smaller diameter and the longitudinal length of the portion of the space having the smaller diameter are shorter than the length of the stroke of the piston means.

As the piston means is located in the end adjacent the outlet opening, the piston means joins to the body part so as to close the flow path to the inlet opening. Because of this, the arrangement according to the invention also functions as a so-called flow fuse.

The arrangement according to the invention allows limiting the mass flow of the fuel injected in the beginning of the injection while allowing a sufficient injection pressure during the actual injection. Further, the arrangement according to the invention also preferably produces a fuel flow fuse.

BRIEF DESCRIPTION OF THE DRAWINGS

In the following the invention is described by way of example and with reference to the appended schematic drawings, of which

DETAILED DESCRIPTION

Figure 1:
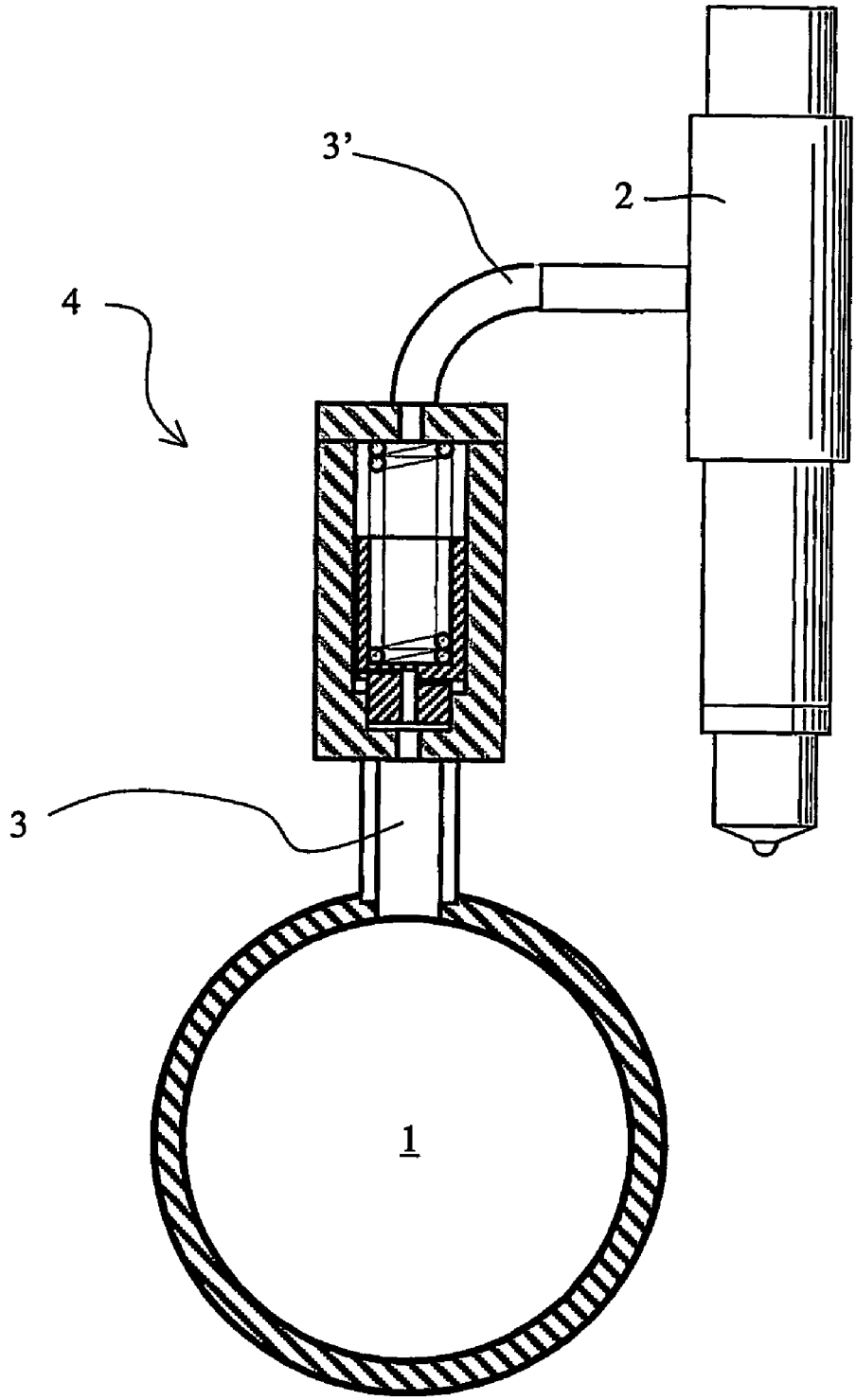
FIG. 1 shows the arrangement according to the invention being applied to the fuel injection system of an engine.

FIG. 1 shows very schematically, how the arrangement 4 according to the invention can be arranged in connection with a common rail fuel injection system of an internal combustion engine. Such a fuel injection system is known as such, and it is described here only as far as is essential for understanding the operation of the invention. The fuel injection system based on a common rail comprises as its main components the common rail, i.e. pressure accumulator 1, in which fuel is stored in high pressure to be injected into the engine and which the injection valve 2 is in flow connection. A fuel channel system 3, 3' has been arranged between the common rail 1 to injection valve 2 metering the fuel to each cylinder (not shown) During operation, a sufficient pressure is maintained in the common rail achieving sufficient injection pressure for the injection valve 2. Each injection valve 2 comprises control means (not shown) for independently controlling the injection. Arrangement 4, the operation of which is described with reference to FIGS. 2–8, has been provided in the fuel channel system 3, 3'.

Figure 2:
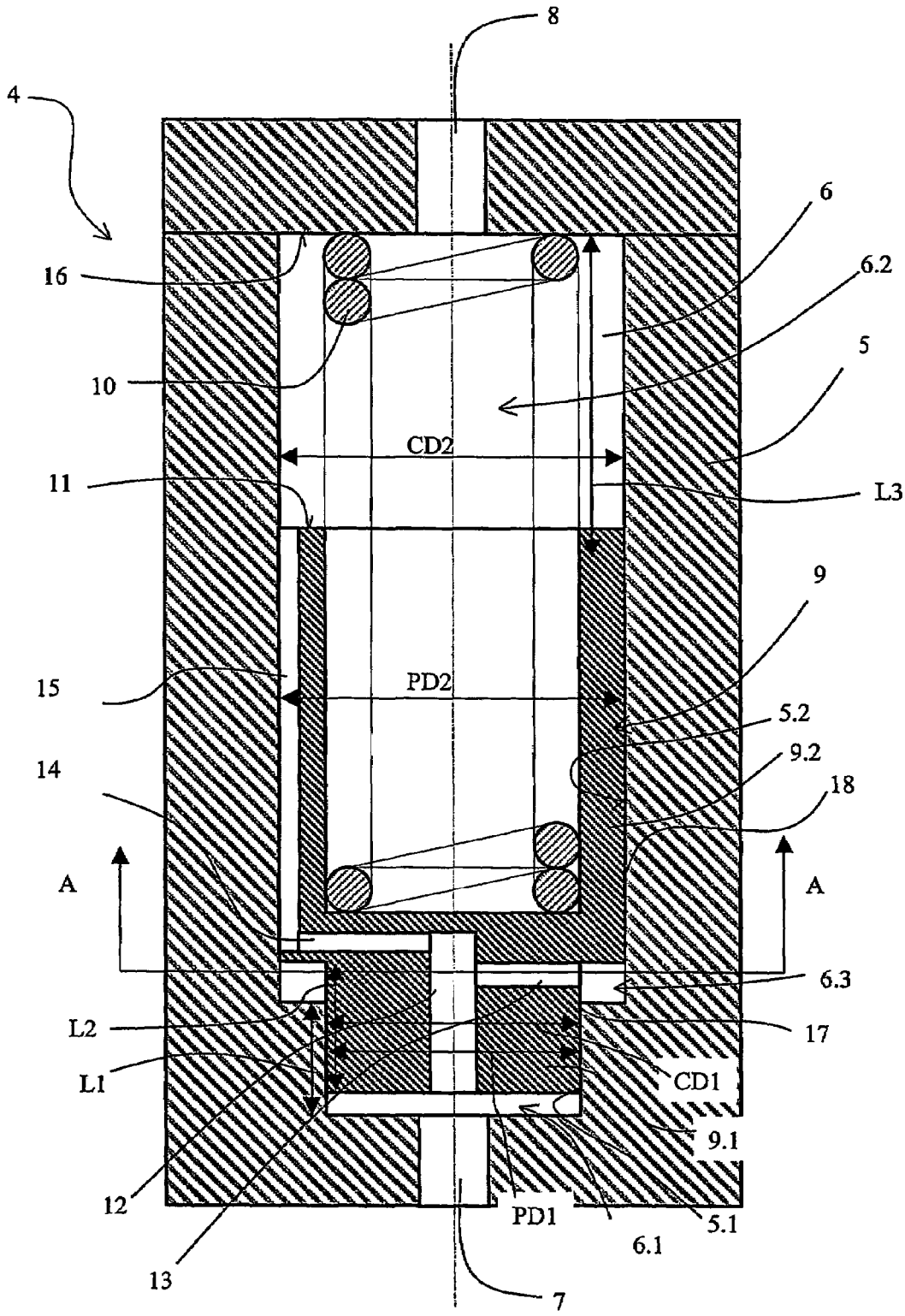
FIG. 2 shows an embodiment of the arrangement according to the invention.
Figure 3:
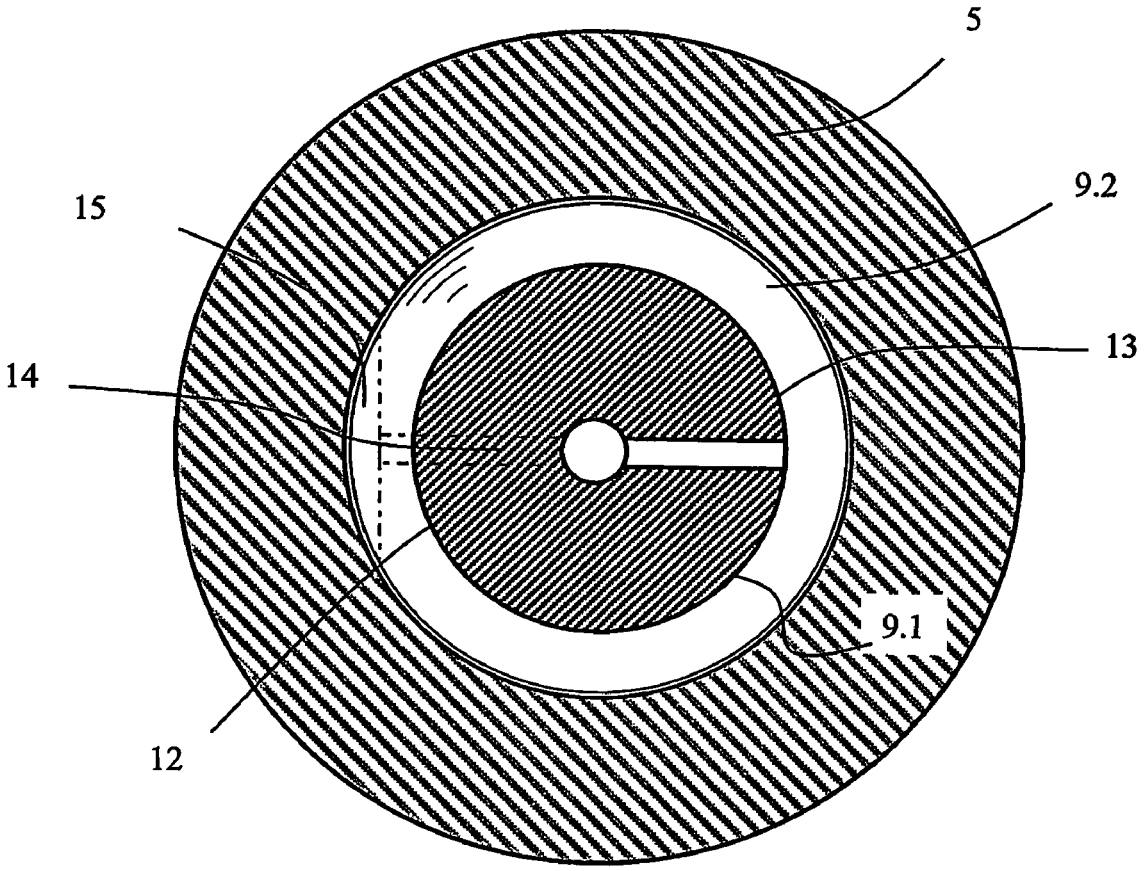
FIG. 3 is section A—A of FIG. 2.

FIG. 2 shows the arrangement according to the invention in the position taken during injection and FIG. 3 shows the section A—A of FIG. 2. Arrangement 4 comprises a body part 5 with a cylindrical space 6 for fuel arranged therein. The fuel inlet opening 7 and the outlet opening 8 have also been arranged in the body part 5, in connection with the fuel space. The space 6 is also provided with a piston means 9. The piston means comprises a channel or the like, such as the combination of bore 12, 14 and the plane surface 15 of the piston means, the combination allowing fuel to flow from the inlet opening 7 to the outlet opening 8. The piston means divides the space 6 mainly into two parts, the first part 6.1 in connection with the inlet opening 7 and the second part 6.2 in connection with the outlet opening 8. A spring or the like 10 has also been provided in the space 6 for creating a pushing force acting on the piston means, in a direction opposite the main direction of the fuel flow. A mating face 11 for sealing arrangement has been provided in the piston means, in the side adjacent the outlet opening 8, and consequently the body part 5 also comprises the mating face 16 of the sealing arrangement. These allow the piston means to join the body part 5 so that the mating surfaces close the fuel flow connection to the inlet opening 7, when the piston means is located in the second part adjacent the part 6.2. Thus, the arrangement according to the invention also acts as a flow fuse.

The space 6 and the piston means 9 are cylindrical. The piston means 9 comprises a portion 9.2 having a larger diameter, the diameter PD2 of which corresponds with the diameter CD2 of the portion 5.2 of the space. Both the space 6 and the piston means 9 comprise portions 5.1, 9.1, the diameters of which are smaller. The diameter of the portion 9.1 of the piston means having the smaller diameter is marked with reference PD1. The diameter of the portion 5.1 of the body part having the smaller diameter is marked with reference CD1.

In the arrangement the piston means 9 and the space 6 are formed so that when the piston means is in the end adjacent the fuel inlet opening 7 they delimit at least a third space 6.3, the volume of which depends on the mutual positions of the piston means 9 and the body part 5. In this case, the position of the piston means can also be determined to be at the end adjacent the first part 6.1 of the space. Firstly, the space 6 comprises at least two portions 5.1, 5.2 having two different diameters CD1, CD2, the portion 5.1 having the smaller diameter CD1 being in the end adjacent the part 6.1 of the first space and additionally the piston means 9 correspondingly comprises two portions 9.1, 9.2 having two different diameters PD1, PD2, the portion 9.1 having the smaller diameter PD1 being located in the end adjacent the first part 6.1 of the space. Now, the longitudinal length L2 of the smaller portion 9.1 of the piston means and the longitudinal length L1 of the part 5.1 of space 6 having the smaller diameter are both separately shorter than the length L3 of the stroke of the piston means 9. Thus, when the portions of the space 6 and the piston means 9 having the smaller diameter are one inside the other, a third part 6.3 of the space 6 is formed by the places where the diameters change. The piston means 9 and the space 6 are cylindrically formed and together they form, by means of their construction and shape, at least two separate sliding surfaces 17, 17', 18, formed at different distances in relation to the central axis of the piston means and the space. When the piston means retracts from the end adjacent the inlet opening 7 for a certain distance L1 the sliding surface 17, 17' ceases to exist and the third part 6.3 of the space and the first part 6.1 of the space are combined. The effect this has on the operation of the arrangement is described in the following.

Figure 4:
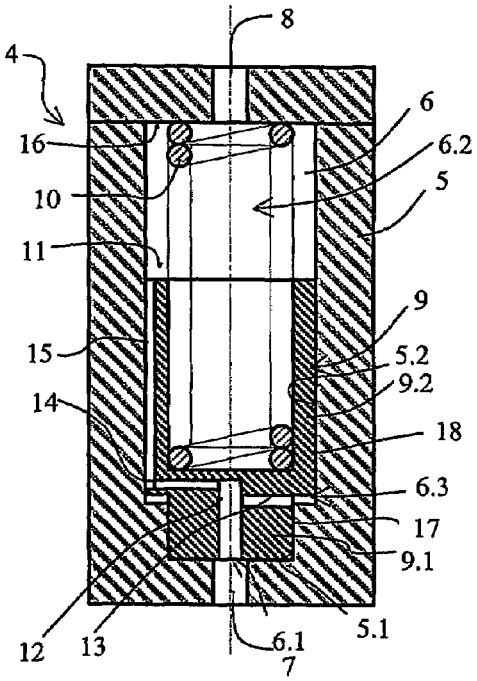
FIG. 4 shows the arrangement of FIG. 2 in a first extreme situation.
Figure 5:
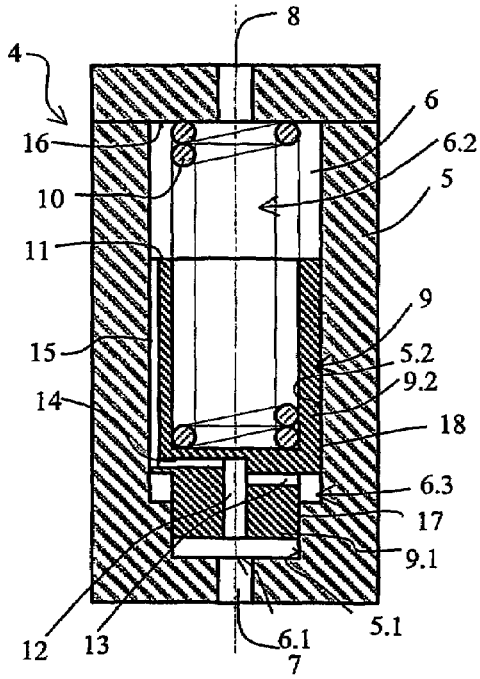
FIG. 5 shows the arrangement of FIG. 2 in an intermediate situation.

When the piston means 9 is in the initial position, as shown in FIG. 4, the injection is about to start. In this case, the pressure of the fuel is about same in all parts 6.1, 6.2 and 6.3 of the space 6 and the force of the spring 10 has previously pushed the piston means 9 to the initial position, i.e. to the end adjacent the inlet opening 7 of the part 6.1 of the space. When the injection starts, the injection valve 2 is opened. This causes a pressure decrease in the outlet opening 8 and the second part 6.2 of the space 6 connected therewith. As a result of this, the total effect of the forces acting on the piston means is changed and the piston means starts to retract from the end adjacent the first part 6.1 of the space, trying to equalize the pressure difference over the piston means. This situation is shown in FIG. 5.

The forces mainly determining the movement of the piston means are formed by the pressures prevailing at various parts of the space, and the force of the spring. In other words, the spring force and the force determined by the pressure in the second part 6.2 of the space and the diameter PD2 of the piston means act against the direction of the fuel flow and the forces acting in the direction opposite these forces are the force determined by the pressure in the first part 6.1 of the space and the diameter DP1 of the piston means and the force determined by the pressure in the third part 6.3 and the difference of the diameters DP2–DP1 of the piston means, in a way known as such. As the injection proceeds, the piston means continues its movement while the third part 6.3 of the space increases and the pressure in this volume tends to decrease. The pressure is however equalized by the fuel flow through the flow channels formed by bores 12, 13. Channel 13 is formed as a throttling channel having a relatively small diameter, and it thus allows controlling the speed of pressure equalization between the third part 6.3 and the first part 6.1 of the space. Generally, the factors having an effect on this are flow resistance properties of the flow channel 12, 13. As the above-mentioned equalization of pressure differences slows the movement of the piston means 9, pressure in the second part 6.2 of the space 6 as well as in the outlet opening 8 is in this situation smaller than in the inlet opening 7. Thus, the mass flow of the injected fuel is smaller as well.

The above-mentioned procedure can be illustrated by the equilibrium equation of the forces acting on the piston means.

$$P_{first\ part\ 6.1} \cdot A_1 + P_{third\ part\ 6.3} \cdot A_3 = P_{second\ part\ 6.2} \cdot A_2 + \text{spring force}$$

With equilibrium in the equation, the pressure $p_{third\ part\ 6.3}$ must decrease, as the pressure $p_{second\ part\ 6.2}$ decreases when the injection nozzle opens. In this situation the areas remain the same and the spring force does not change considerably, either. The pressure level in the third part 6.3 of the space can be controlled by choosing suitable diameters for the various portions 5.1, 5.2, 9.1, 9.2 of the piston means and the space as well as by dimensioning of the flow channel 12, 13.

Figure 6:
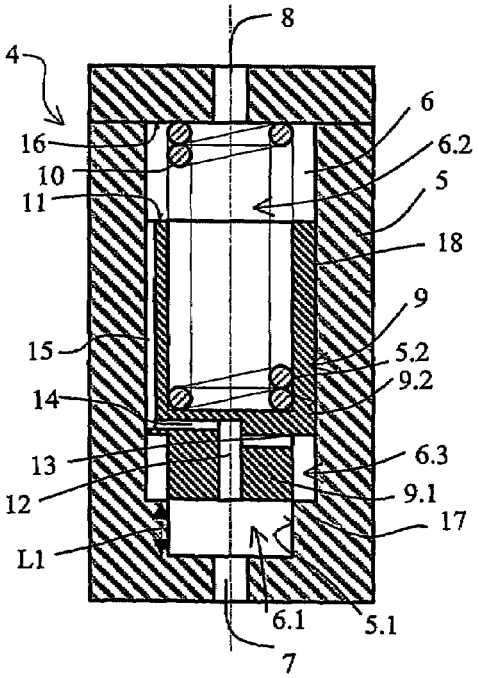
FIG. 6 shows the arrangement of FIG. 2 in another intermediate situation.

In FIG. 6 the piston means has retracted the distance L1 away from the end adjacent the first part 6.1 of the space, and at this distance the portion 9.1 having the smaller diameter exits from the portion 5.1 of the space 6 having the smaller diameter. Thus, the sliding surface 17 formed by these ceases to exist, whereby the third part 6.3 and the first part 6.1 of the space are combined. Subsequent to this the pressure difference between the inlet opening 7 and the outlet opening 8 is very small, because the piston means can move without being essentially dampened.

Figure 7:
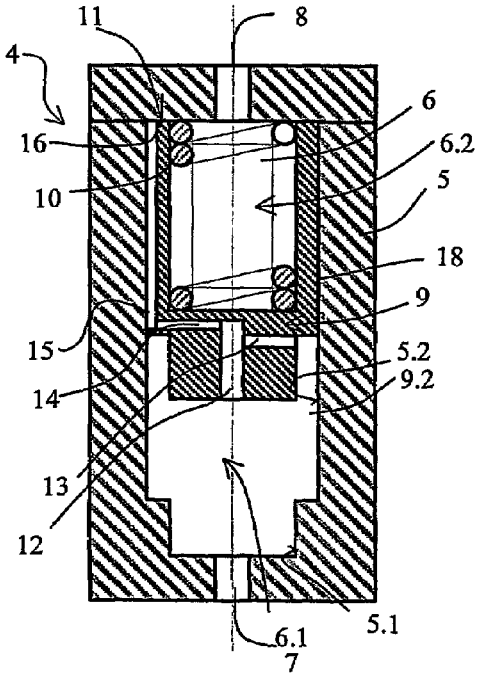
FIG. 7 shows the arrangement of FIG. 2 in another extreme situation.

During normal operation the piston means does not reach the position shown in FIG. 7. The length of the stroke of the piston means is determined by the fuel used during fuel injection. FIG. 7 illustrates a situation, where a malfunction has caused so much fuel to flow through the arrangement according to the invention that the piston means 9 is in the end adjacent the second part 6.2 of the space. Thereby the piston means is joined to the body part 5 so that they together close the flow connection of fuel between the inlet opening 7 and the outlet opening, i.e. the arrangement according to the invention also acts as a flow fuse.

Figure 8:
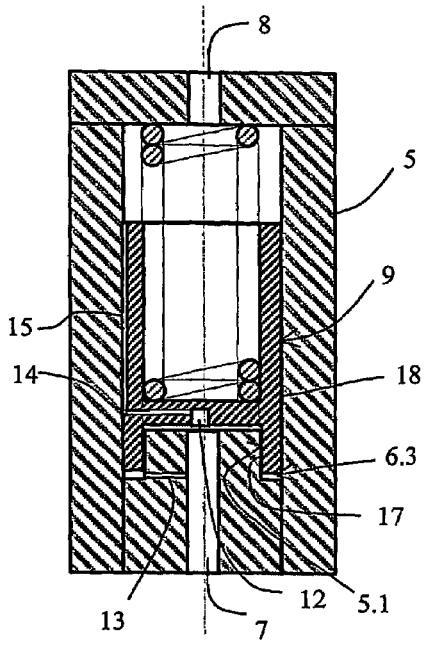
FIGS. 8–10 show various embodiments of the arrangement of FIG. 2.
Figure 9:
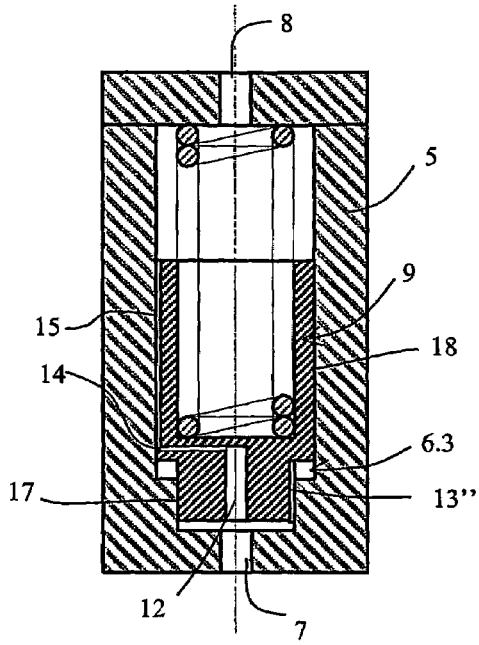
Figure 10:
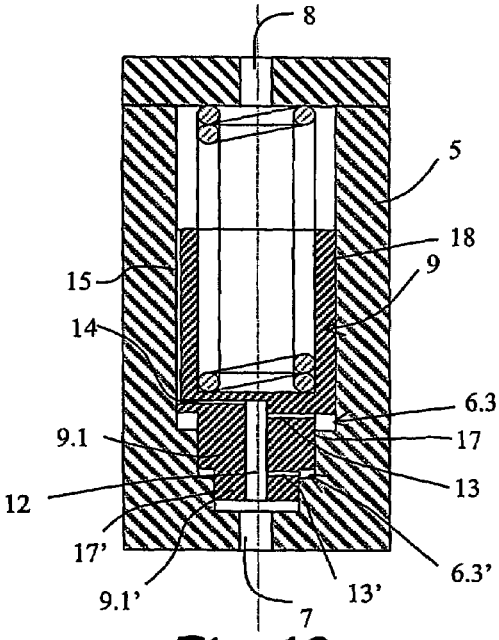

FIGS. 8–10 show various embodiments of the invention. FIG. 8 illustrates an embodiment in which the portion 5.1 of the space having the smaller diameter extends inside the space 6 and correspondingly a space has been arranged in the piston means 9 for accommodating this extension of the body part. In this embodiment the sliding surfaces 17, 18 are arranged concentrically on the same longitudinal position. In this embodiment the throttling channel 13 is arranged on the body part 5 instead of the piston means. FIG. 9 shows a construction otherwise corresponding with that of FIGS. 4–7, but instead of a bore the throttling channel has been arranged from the plane surface 13" of the piston means 9. The flow resistance properties of this can be changed by changing the size thereof and also by arranging the direction of the plane to deviate from that of the longitudinal axis, i.e. arranging a slanted plane. Instead of a plane surface or in addition to it the sliding surface 17 having the smaller diameter can be arranged wholly or partially conical (not shown in the figures). FIG. 10 illustrates how the third part 6.3 of the space 6 is formed by two different parts 6.3, 6.3'. Thus, the portion 9.1 of the piston means having the smaller diameter is formed by two different portions 9.1, 9.1' having different diameters and simultaneously forming three separate sliding surfaces 18, 17, 17' with the body part. Of these, the sliding surfaces 17, 17' determine the existence of the parts 6.3, 6.3' of the space on the basis of the location of the piston means. There can naturally be more of these. In this embodiment the throttling channels of the separate parts 6.3 and thereby also their dampening properties can be individually determined.

The invention is not limited to the embodiments described here, but a number of modifications thereof can be conceived of within the scope of the appended claims.

I claim:

1. An arrangement in a fuel injection system for controlling the fuel injection, the arrangement comprising a body part having a space arranged therein, through which space the fuel to be injected during operation flows, and a fuel inlet opening and an outlet opening opening into the space, additionally the arrangement further comprises a piston means arranged movably inside the space, the piston means having a channel arranged therein for creating a flow connection between the fuel inlet opening and the outlet opening, whereby in the arrangement the piston means can divide the space into a first part being in connection with the inlet opening and a second part being in connection with the outlet opening, the arrangement further comprising a spring for creating a force acting on the piston means in a direction opposite to the main direction of the fuel flow, wherein in the arrangement the piston means and the body part delimit at least one third part as the piston means is in the end adjacent the inlet opening or near it, the volume of the third part being dependent on the mutual positions of the piston means and the body part.

2. An arrangement according to claim 1, wherein the piston means and the space are cylindrically formed and together they form at least two separate sliding surfaces formed at different distances from the central axis of the piston means and the space.

3. 0n arrangement according to claim 1, wherein when the piston means is in the end adjacent the inlet opening the volume of the third part is at its smallest and as the piston means retracts a certain distance away from the end adjacent the inlet opening the volume of the third part increases and that as the piston means retracts beyond the certain distance, the third part and the first part of the space are combined.

4. In arrangement according to claim 1, wherein the third part of the space is in continuous flow connection with the fuel inlet opening and/or the first part of the space.

5. An arrangement according to claim 4, wherein the flow connection is achieved by means of a throttling channel.

6. An arrangement according to claim 1, wherein the space is cylindrical and it comprises at least two portions having different diameters, with the portion having the smaller diameter being in the end adjacent the inlet opening and that the piston means correspondingly comprising two portions having different diameters, with the portion having the smaller diameter being in the end adjacent the inlet opening and that both the longitudinal length of the portion of the piston means having the smaller diameter and the longitudinal length of the of the portion of the space having the smaller diameter are shorter than the length of the stroke of the piston means.

7. An arrangement according to claim 1, wherein when the piston means is in the end adjacent the outlet opening the piston means joins the body part so that they together close the flow connection of fuel to the inlet opening.

8. A fuel injection control valve comprising:

a body part defining an interior space having an inlet end and an outlet end and through which fuel to be injected during operation of the control valve flows, and also defining a fuel inlet opening and a fuel outlet opening that open into the interior space at the inlet and outlet ends respectively of the interior space, a piston arranged movably in the interior space and dividing the interior space into a first part that is in communication with the fuel inlet opening and a second part that is in communication with the fuel outlet opening, the piston being formed with a passage for providing a flow connection between the fuel inlet opening and the fuel outlet opening, and a resilient member urging the piston in a direction opposite to the main direction of the fuel flow, and wherein when the piston is at or near the inlet end of the interior space, the piston and the body part bound a third part of the interior space, said third part of the interior space being in throttled communication with the second part for controlling equalization of pressure between the second and third parts.

9. A fuel injection control valve according to claim 8, wherein the piston and the interior space are substantially circular in cross section and have a common central axis, and when the piston is at or near the inlet end of the interior space, the piston and the body part have at least two surfaces in sliding contact at different respective radial distances from the common central axis of the piston and the interior space.

10. A fuel injection control valve according to claim 8, wherein the volume of the third part of the interior space is dependent on the position of the piston relative to the body part, and when the piston is at the inlet end of the interior space the volume of the third part of the interior space is at a minimum and as the piston moves away from the inlet end the volume of the third part increases.

11. A fuel injection control valve according to claim 8, wherein when the piston moves away from the inlet end the volume of the third part increases until the piston reaches a predetermined distance away from the inlet end, and when the piston means moves beyond said predetermined distance, the third part and the first part of the interior space are combined.

12. A fuel injection control valve according to claim 8, wherein the third part of the interior space is in flow connection with the fuel inlet opening and/or the first part of the interior space.

13. A fuel injection control valve according to claim 12, wherein the third part of the interior space is in throttled communication with the first part of the interior space.

14. A fuel injection control valve according to claim 8, wherein the interior space is substantially circular in cross section and comprises a smaller diameter portion and a larger diameter portion, the smaller diameter portion of the interior space is between the larger diameter portion and the inlet end, the piston correspondingly comprising a smaller diameter portion and a larger diameter portion, and both the longitudinal length of the smaller diameter portion of the piston and the longitudinal length of the smaller diameter portion of the interior space are shorter than the length of the stroke of the piston means.

15. A fuel injection control valve according to claim 8, wherein when the piston is at the end adjacent the outlet opening, the piston engages the body part so that they together prevent flow of fuel from the inlet opening to the outlet opening.

16. A fuel injection control valve according to claim 8, wherein the interior space is substantially circular in cross section and comprises a smaller diameter portion and a larger diameter portion, the smaller diameter portion of the interior space is between the larger diameter portion and the inlet end, the piston correspondingly comprising a smaller diameter portion and a larger diameter portion, and when the piston is at or near the inlet end of the interior space the smaller diameter portion of the piston is in sliding contact with the body part bounding the smaller diameter portion of the interior space and the larger diameter portion of the piston is in sliding contact with the body part bounding the larger diameter portion of the interior space.

* * * * *